US010507356B2

(12) United States Patent
Noren et al.

(10) Patent No.: US 10,507,356 B2
(45) Date of Patent: Dec. 17, 2019

(54) PORTABLE AND STOWABLE VERTICAL KNEE RAISE EXERCISE APPARATUS AND SYSTEM

(71) Applicants: Scott Noren, Ithaca, NY (US); Aren Paster, Balston Spa, NY (US); Maeve Conway, Delmar, NY (US); Taylor Valdez, Fitchburg, WI (US); Larry D. Oligny, Stephentown, NY (US); Aaron Clippinger, Troy, NY (US)

(72) Inventors: Scott Noren, Ithaca, NY (US); Aren Paster, Balston Spa, NY (US); Maeve Conway, Delmar, NY (US); Taylor Valdez, Fitchburg, WI (US); Larry D. Oligny, Stephentown, NY (US); Aaron Clippinger, Troy, NY (US)

(73) Assignee: Scott Noren, Ithaca, NY (US)

( * ) Notice: Subject to any disclaimer, the term of this patent is extended or adjusted under 35 U.S.C. 154(b) by 142 days.

(21) Appl. No.: 15/831,711

(22) Filed: Dec. 5, 2017

(65) Prior Publication Data

US 2019/0329095 A1 Oct. 31, 2019

Related U.S. Application Data

(60) Provisional application No. 62/430,471, filed on Dec. 6, 2016.

(51) Int. Cl.

| | |
|---|---|
| ***A63B 23/02*** | (2006.01) |
| *A63B 23/04* | (2006.01) |
| *A63B 23/035* | (2006.01) |

(52) U.S. Cl.

CPC ..... *A63B 23/0216* (2013.01); *A63B 23/02* (2013.01); *A63B 23/0205* (2013.01); *A63B 23/0355* (2013.01); *A63B 23/03516* (2013.01); *A63B 23/04* (2013.01); *A63B 23/0405* (2013.01); *A63B 23/0482* (2013.01); *A63B 23/0494* (2013.01); *A63B 2208/029* (2013.01); *A63B 2208/0285* (2013.01); *A63B 2210/00* (2013.01); *A63B 2210/50* (2013.01)

(58) Field of Classification Search

CPC . A63B 23/02; A63B 23/0205; A63B 23/0216; A63B 23/03516; A63B 23/0355; A63B 23/04; A63B 23/0405; A63B 23/0482; A63B 23/0494; A63B 2208/0285; A63B 2208/029; A63B 2210/00

See application file for complete search history.

(56) References Cited

U.S. PATENT DOCUMENTS

| | | | | |
|---|---|---|---|---|
| 5,080,352 A * | 1/1992 | Freed | ..... | A63B 21/00047 482/140 |
| 6,179,759 B1 * | 1/2001 | Tellone | ..... | A63B 23/0211 482/111 |
| 2015/0352395 A1 * | 12/2015 | Gregory | ..... | A63B 23/03558 482/123 |

* cited by examiner

*Primary Examiner* — Joshua Lee

(74) *Attorney, Agent, or Firm* — Randall L. Reed; Miller Mayer LLP

(57) ABSTRACT

A vertical knee raise machine that is portable, which can be folded into a compact unit for storage but than be quickly and easily set up for use. The machine includes a foldable tripod base and folding arms to allow it to be folded up for ease of storage.

13 Claims, 7 Drawing Sheets

PORTABLE AND STOWABLE VERTICAL KNEE RAISE EXERCISE APPARATUS AND SYSTEM

CROSS-REFERENCE TO RELATED APPLICATIONS

This application claims the benefit of priority under 35 U.S.C. § 120 and any other relevant law of: U.S. Provisional Application Ser. No. 62/430,471 filed on Dec. 6, 2016 the content of which is relied upon and incorporated herein by reference in its entirety.

TECHNICAL FIELD

The disclosure generally relates to a system and apparatus for exercise to maintain physical fitness. More particularly, it relates to a vertical knee raise machine that can be folded up for ease of storage when not in use.

BACKGROUND

The business of exercise equipment and physical fitness devices is a huge business. Given the relatively sedentary styles of most individuals, the failure to exercise leads to various medical problems and physical ailments. The problems are many and varied, from being overweight to lack of stamina to chronic lower back pain, etc. Thus, there is a strong demand for ways to exercise and maintain physical fitness.

The demand for exercise equipment has resulted in the availability of a plethora of different types of exercise equipment. One particular category consists of exercise equipment designed for those who experience lower back pain. Eighty percent of Americans experience chronic lower back pain during their lifetime. One type of exercise device recommended for dealing with lower back pain is the vertical knee raise machine. Proper use of the vertical knee raise machine can increase abdominal girdle strength. Increasing abdominal girdle strength decreases lower back pain. There are a multitude of exercise devices that fall into the category of a vertical knee raise machine. Typical of a common type of vertical knee raise machine is that depicted in FIG. 1. However, the device depicted in FIG. 1 while it is typical of that found at the local gym or health club is not convenient for home use. If you are in an apartment or home when not in use it cannot be conveniently stored and will take up scarce room.

Another example of a vertical knee raise exercise apparatus designed for the home market is the Marcy Power Tower which includes a large triangular base made by Impex company of Pomona, Calif. While this is a multifunction exercise apparatus that includes a vertical knee raise feature, it takes up a significant amount of space and can not be easily folded or disassembled for storage.

In designing exercise equipment for use in the home, a number of factors come into play in order to make it a completive and useful device. It needs to be able to handle the same loads and stress and strain that gym exercise equipment can handle. However, it must also be light enough for an individual to easily pickup and move. Ideally, it should also be foldable into a compact, storable unit. Finally, the cost must be within a reasonable range for individuals on a moderate income to purchase.

There have been attempts to design a sturdy vertical knee raise machine that can be conveniently stored. US patent application publication number 20110190103 of Nguyen depicts an attempt to create a vertical knee raise machine that can, among other things, be disassembled for storage when not in use. However, it uses a series of knobs that need to be tightened which make it inconvenient and subject to failure. Additionally, assembling and disassembly is tedious and time consuming.

Thus, another necessary feature for a vertical knee raise apparatus for home use is that it can be quickly folded for storage or unfolded for use. Typically, this needs to be less than a minute or so.

No admission is made that any reference cited herein constitutes prior art. Applicant expressly reserves the right to challenge the accuracy and pertinence of any cited documents.

SUMMARY

Thus it is objective of the present invention to provide a vertical knee raise machine that can be easily folded up and stored when not in use. A vertical knee raise machine that can be quickly deployed for use and light enough so that an average individual can do it without difficulty or the help of another.

To accomplish these and other objectives a vertical knee raise machine is provided that has: a) tripod base movable between a deployed support position and folded storage position; b) a backrest with a left armrest connected at a first end to the backrest with a hand grip at a second end of the left armrest and a right armrest connected at a first end to the backrest with a hand grip at a second end of the right armrest; c) a support shaft with a first end connected to the tripod and a second end connected to the backrest; d) wherein a plane formed by the backrest is reclined at a preset oblique angle to the support shaft; and e) the arms retract from a deployed position to a folded position to thereby put the vertical knee raise machine in a compact storage configuration for storage when the armrests are in the retracted position and the tripod is in the folded storage position. In a further aspect the preset oblique angle between the backrest and the shaft is 10°. In yet a further aspect the preset oblique angle between the backrest and the shaft can vary form 50 to 15°.

In a variation of the vertical knee raise machine length of the shaft connecting the tripod to the backrest can be adjusted to vary the distance between the tripod and the backrest, to thereby allow of persons of different height to use the vertical knee raise machine. In another variation one leg of the tripod when the tripod is deployed in the support position forms a plane perpendicular to a plane formed by the back rest and projects in the same direction as the arm rests. In another variation the second end of the support shaft which connects to the back rest is bent at the preset oblique angle to thereby position said backrest at the preset oblique angle.

In another variation of the invention it provides a vertical knee raise machine with: a) a tripod base movable between a deployed support position and folded storage position; b) a backrest with a left armrest connected at a first end to the backrest with a hand grip at a second end of the left armrest and a right armrest connected at a first end to the backrest with a hand grip at a second end of the right armrest; c) a support shaft with a first end connected to the tripod and a second end connected to the backrest; d) wherein a plane formed by the backrest is reclined at a preset oblique angle to the support shaft: e) the arms retract from a deployed position to a folded position to thereby put the vertical knee raise machine in a compact storage configuration for storage when the armrests are in the retracted position and the tripod is in the folded storage position: f) the preset oblique angle between the backrest and the shaft is 10°; g) wherein when the armrests are in the deployed position they form a plane at a right angle to the plane of the backrest; and h) a leg of the tripod when in the deployed position projects in the same direction as the legs of a person using the vertical knee raise machine.

The invention also provides a vertical knee raise exercise method that involves providing an apparatus having articulations permitting storage in a substantially flat configuration and permitting a working configuration adjustable at a desired height for elbow or forearm supports, adjusting the apparatus for use by a user, performing vertical knee raise exercises using the apparatus, and adjusting the apparatus for storage in the substantially flat configuration.

Additional features and advantages will be set forth in the detailed description which follows, and in part will be readily apparent to those skilled in the art from the description or recognized by practicing the embodiments as described in the written description and claims hereof, as well as the appended drawings:

It is to be understood that both the foregoing general description and the following detailed description are merely exemplary, and are intended to provide an overview or framework to understand the nature and character of the claims.

The accompanying drawings are included to provide a further understanding, and are incorporated in and constitute a part of this specification. The drawings illustrate one or more embodiment(s), and together with the description serve to explain principles and operation of the various embodiments.

DETAILED DESCRIPTION

Figure 1:
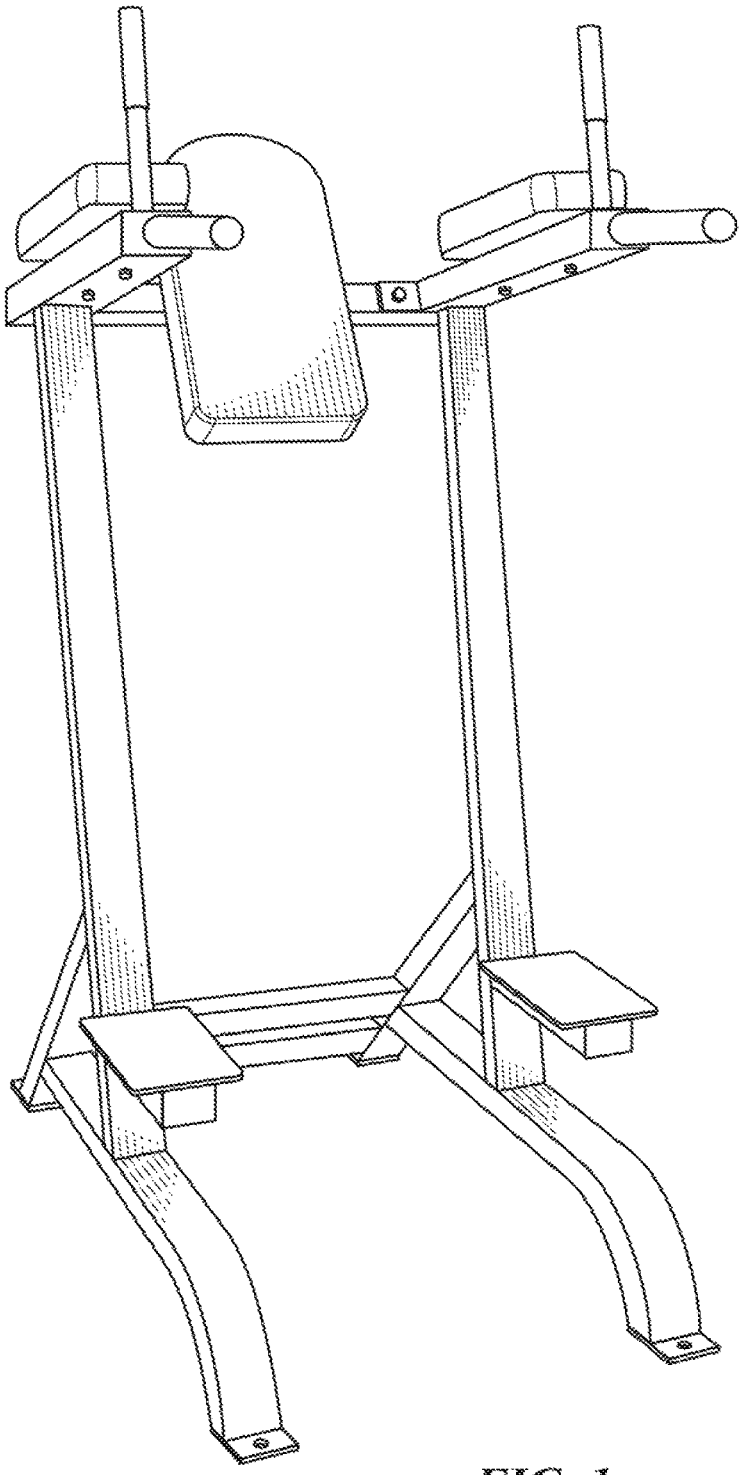
FIG. 1 (Prior Art)
FIG. 1 is a perspective view of a prior art machine.
Figure 2:
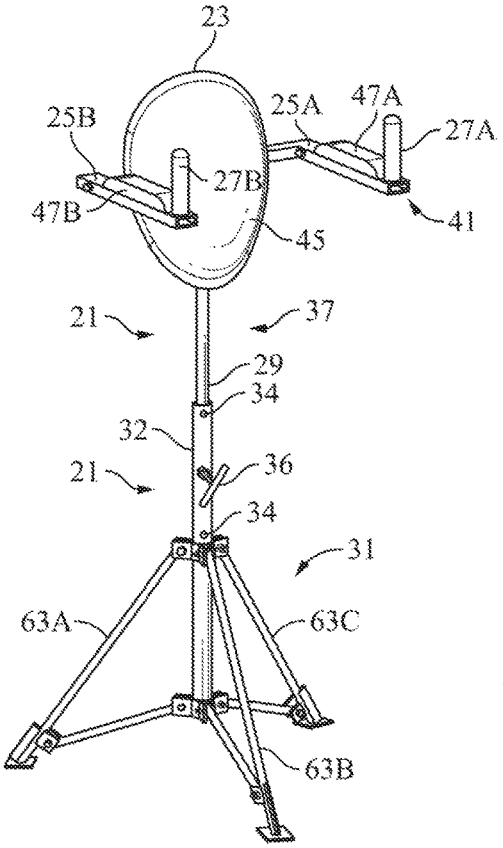
FIG. 2 is a perspective view of an embodiment of the vertical knee raise machine of the present invention in the deployed configuration.
Figure 3:
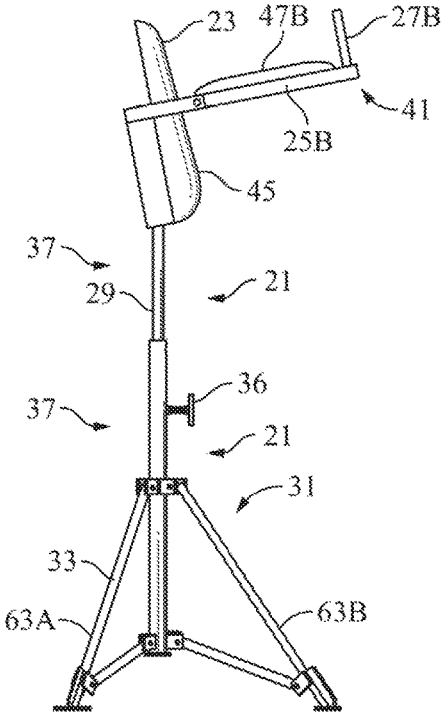
FIG. 3 is a side view of an embodiment of the vertical knee raise machine of the present invention in the deployed position.
Figure 4:
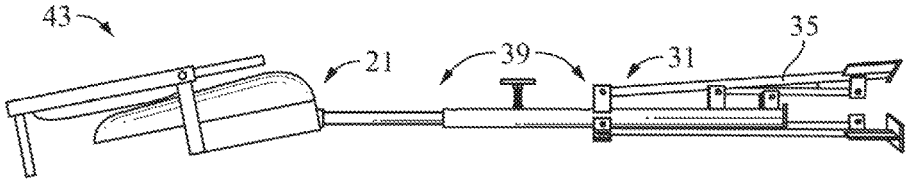
FIG. 4 is a view of an embodiment of the vertical knee raise machine of the present invention in the folded configuration.
Figure 4C:
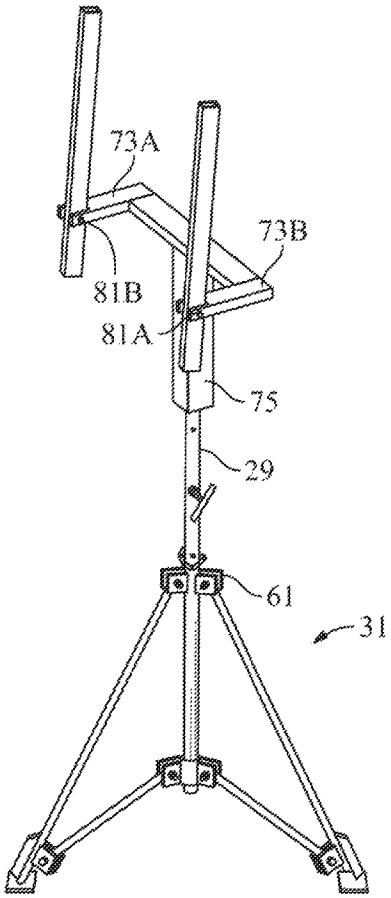
FIG. 4A to 4D are the steps by which an embodiment of the vertical knee raise machine of the present invention is transformed from its deployed configuration to its storage configuration.
Figure 4B:
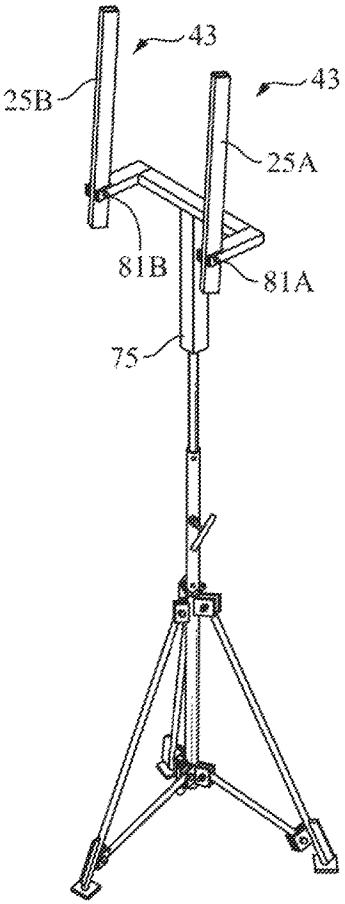

FIG. 2 provides a perspective view of an embodiment of the vertical knee raise machine (VKR) 21 of the present invention in the deployed position. It includes a backrest 23, a left armrest 25A, and a right armrest 25B. Left armrest 25A has hand grip 27A and right armrest 25B has hand grip 27B. Support shaft 29 and tripod 31 make up the rest of the other major functional parts. FIG. 3 provides a side view of the deployed vertical knee raise machine. FIG. 4 provides a view of the vertical knee raise machine in a folded configuration 39 ready for storage. In FIGS. 2 and 3 tripod 31 is in the deployed support position 33. In FIG. 4 tripod 31 is in the folded storage position 35.

Figure 4A:
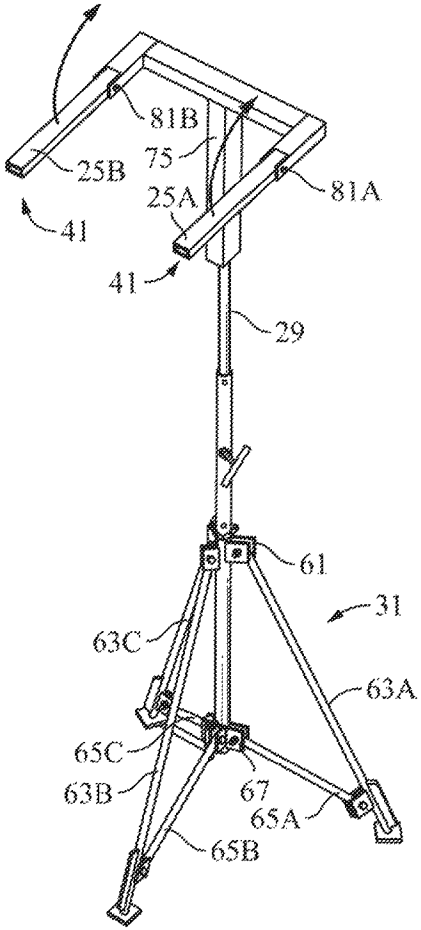

FIGS. 4A to 4D depict the steps by which the vertical knee raise is transformed from its deployed position 37 to its folded storage configuration 39. Referring to FIG. 4A, the vertical knee raise machine 21 is in the deployed position 37. (Back rest 23 has been removed from FIGS. 4A to 4D to provide an unobstructed view of the other parts of the vertical knee raise machine 21; however, in use and during storage the back rest would typically be attached as depicted in FIGS. 2, 3 and 4.) In preparing the vertical knee raise machine for storage, the armrests 25A and 25B are retracted from the deployed position 41 of FIG. 4A to the fully retracted position 43 of FIG. 4B. Left arm rest 25A pivots between the deployed position 41 and the retracted position 43 at left arm rest pivot bolt 81A and right arm rest 25B pivots between the open deployed position 41 and the closed folded 43 on right arm rest pivot bolt 81B. The next step is the unlatching of the tripod base 31, FIG. 4C, and then the retracting of the tripod base 31 to the folder storage position 35, FIG. 4D. More detail regarding the structure of the arm rests and tripod will be provided below.

In the embodiment depicted in FIGS. 2, 3, 4, back rest 23 has a cushion 45 on the side on which the back of a user of the apparatus would rest. Likewise, cushions 47A and 47B are on left armrest 25A and right armrest 25B respectively. Those familiar with the art are aware that there are many types of padded rests or cushions and ways to attach them to the backrest and armrests.

Figure 5A:
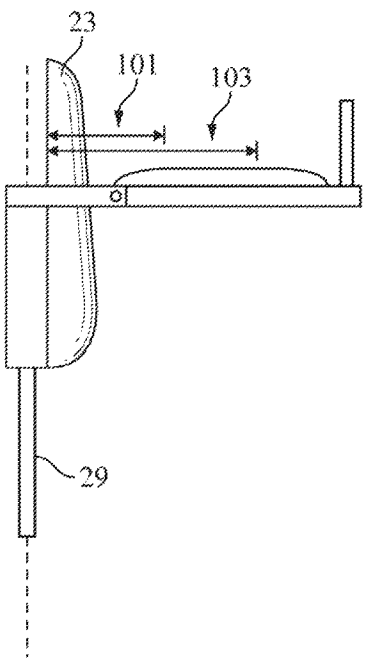
FIG. 5A provides a schematic diagram of the shifting of the center of mass of a person using a version invention with an upright back from a position where the legs of the user are hanging straight down to fully extended out.
Figure 5:
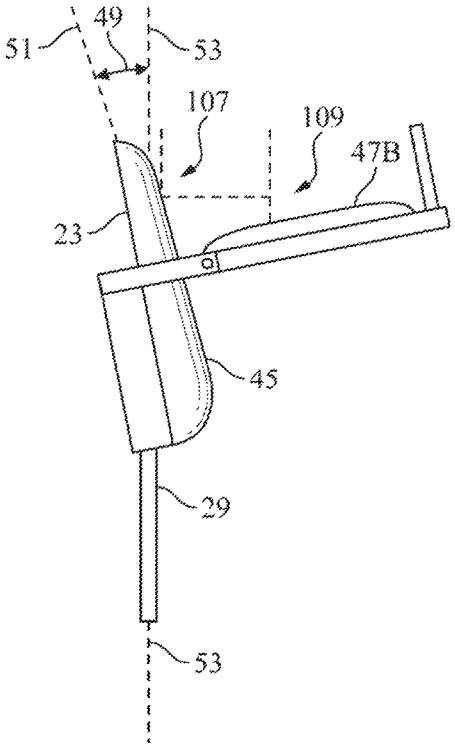
FIG. 5 is a side view of the backrest and armrests with vertical shaft of an embodiment of the vertical knee raise machine of the present invention.
Figure 4D:
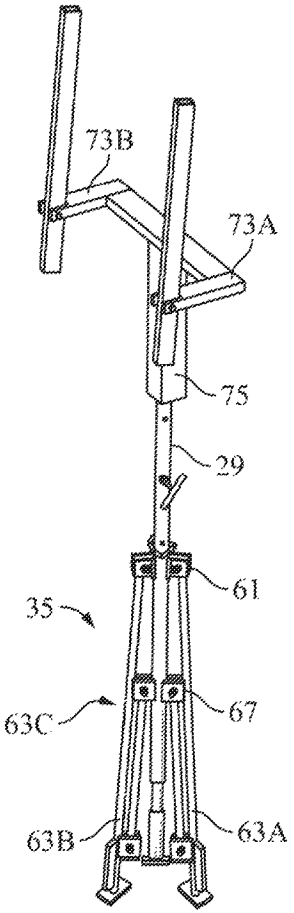

FIG. 5 provides a side view of the support shaft 29 and backrest 23. In the embodiment depicted backrest 23 is inclined slightly backwards as evidenced by angle 49 between plane S1 formed by backrest 23 and plane 53 formed by support shaft 29. As will be discussed in detail below this slight backward slant as indicated by angle 49 makes the machine more stable during use. As will be discussed below the slanted back has advantages with respect to the design and construction of the VKR machine of the present invention. Additionally, provides better form for the exercise and is more comfortable for the user.

Referring back to FIG. 4A, tripod base 31 has an upper fixed bracket 61 that surrounds center support shaft 29 and is securely attached to shaft 29. On the other hand, lower sliding bracket 67, once unlatched, can slide up and down support shaft 29. Three legs of the tripod 63A, 638 and 63C are each hingedly attached at an upper end to upper bracket 61 and hingedly attached to a retaining bar 65A, 65B and 65C respectively at their lower ends. The retaining bars 65A, 65B and 65C attach at their opposite ends to lower sliding bracket 67. Lower sliding bracket 67 surrounds support shaft 29 and when lower sliding bracket 67 is unlatched and moved up from its position in FIG. 4C to the position depicted in FIG. 4D, upper fixed bracket 61 remains in place and legs 63A. 63B and 63C are pulled into a folded position adjacent to support shaft 29 by retaining bars 65A, 65B and 65C, respectively.

Figure 6:
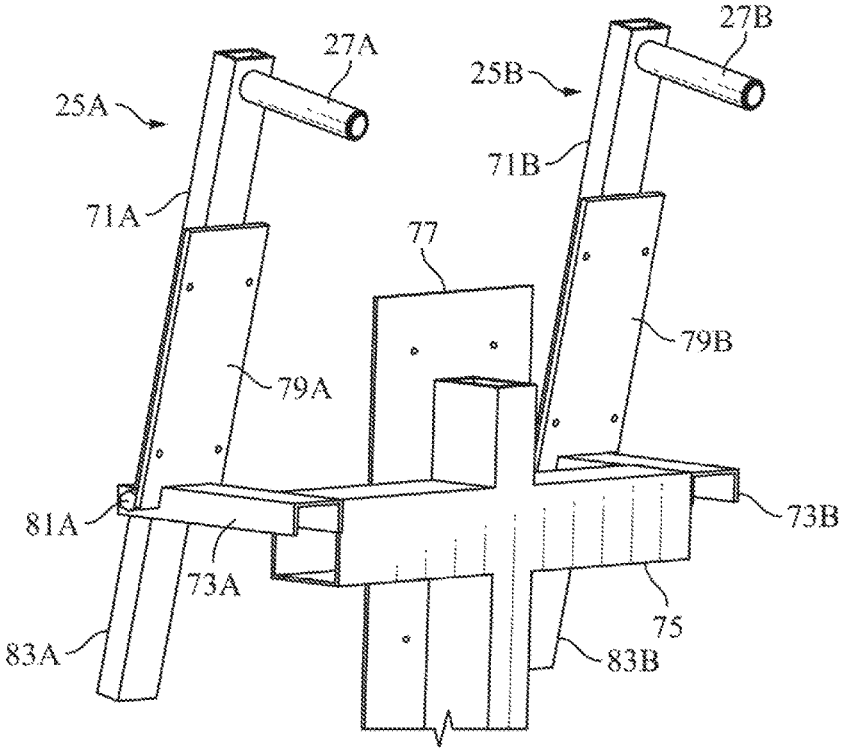
FIG. 6 depicts an embodiment of the invention with the arms in the folded position.

The following is a more detailed discussion of the structure and folding mechanism of left arm rest 25A. Referring to FIG. 6, the arms rests of an embodiment of the vertical knee raise machine are depicted in a folded storage position. (Again the back rest has been removed and the arm pads removed to provide an unobstructed view of the features of the folding arm mechanism of the depicted embodiment of the vertical knee raise machine but, naturally, would be on the machine when in use.) The parts of the folding arm mechanism of left arm rest 25A include left arm support shaft 71A, left arm support shaft pivot bolt 81A, back portion 83A of left arm support shaft 71A, and left arm pad platform 79A. Also, depicted in FIG. 6 is left arm retaining bracket 73A that is securely attached to support super structure 75 that in turn connects to support shaft 29 not shown in FIG. 6. Back rest retaining sheet 77 attaches to support superstructure 75. The connection between support super structure 75 and support shaft 29 is visible in FIGS. 4A to 4D.

As can be seen in the embodiment depicted in FIG. 6, left arm rest 25A is pivotally attached by left arm pivot bolt 81A at a point one third of the way in from the rear end of left arm support shaft 71A to the front end of left arm support bracket 73A. Thus, when left arm rest 25A is pivoted from the folded position 43 in FIG. 6 into the deployed position 41 depicted in FIG. 7 the back portion 83A fits into the underside of left arm support bracket 73A.

Figure 7:
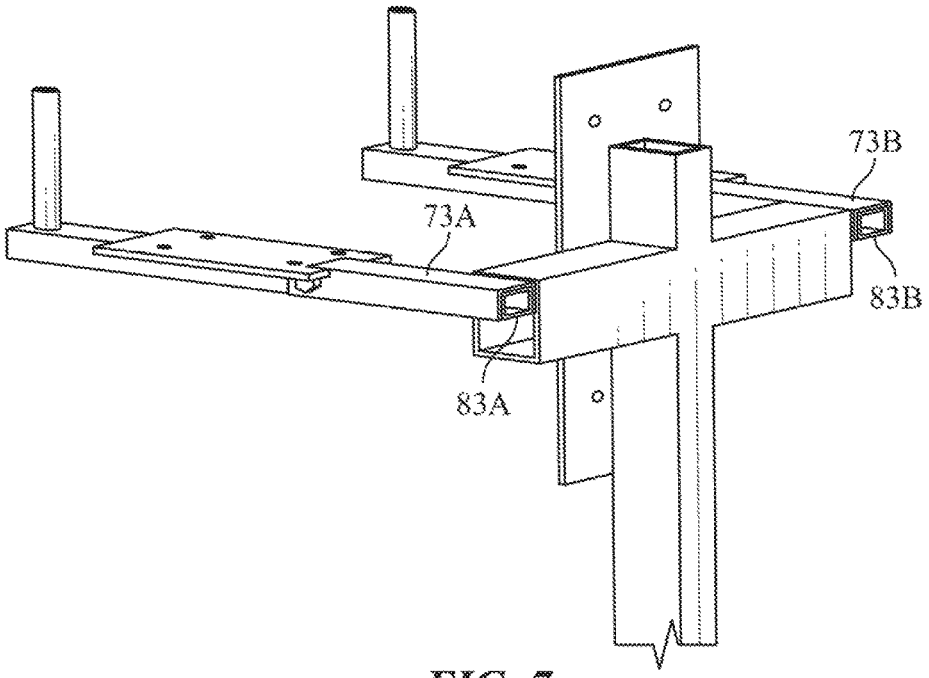
FIG. 7 is the embodiment depicted in FIG. 6 with the arms in the deployed position.

Likewise as depicted in FIGS. 6 and 7 the parts of the folding arm mechanism of right arm rest 258 includes left arm support shaft 71B, back portion 83B, and left arm pad platform 79B. In the view provided by FIGS. 6 and 7 right support arm pivot bolt 81B is not visible, but can be seen in FIGS. 4A to 4D. Right arm retaining bracket that is securely attached to support super structure 75 is also visible.

Referring to FIG. 6 again the right arm rest support shaft 71B is attached in a similar hinged fashion to right arm support bracket 73B by right arm pivot bolt 81B, not visible in FIG. 6 but visible in FIGS. 4A to 4D. In turn, the back end of left arm support bracket 73A is fixedly and securely attached to a projection from support super structure 75 visible in FIG. 6, as well as FIGS. 4A to 4D.

Right arm rest 25B pivots between the deployed position 41 and folded position 43 in the same fashion as left arm rest 25A. Thus, right arm rest 25B pivots on right support arm pivot bolt 81B (see FIGS. 4A and 4B) to the deployed position 41 in FIG. 7 for use. The back third of right arm support shaft 83B fits into the space on the bottom side of right arm support bracket 73B.

Figures 9A, 9B, 9C:
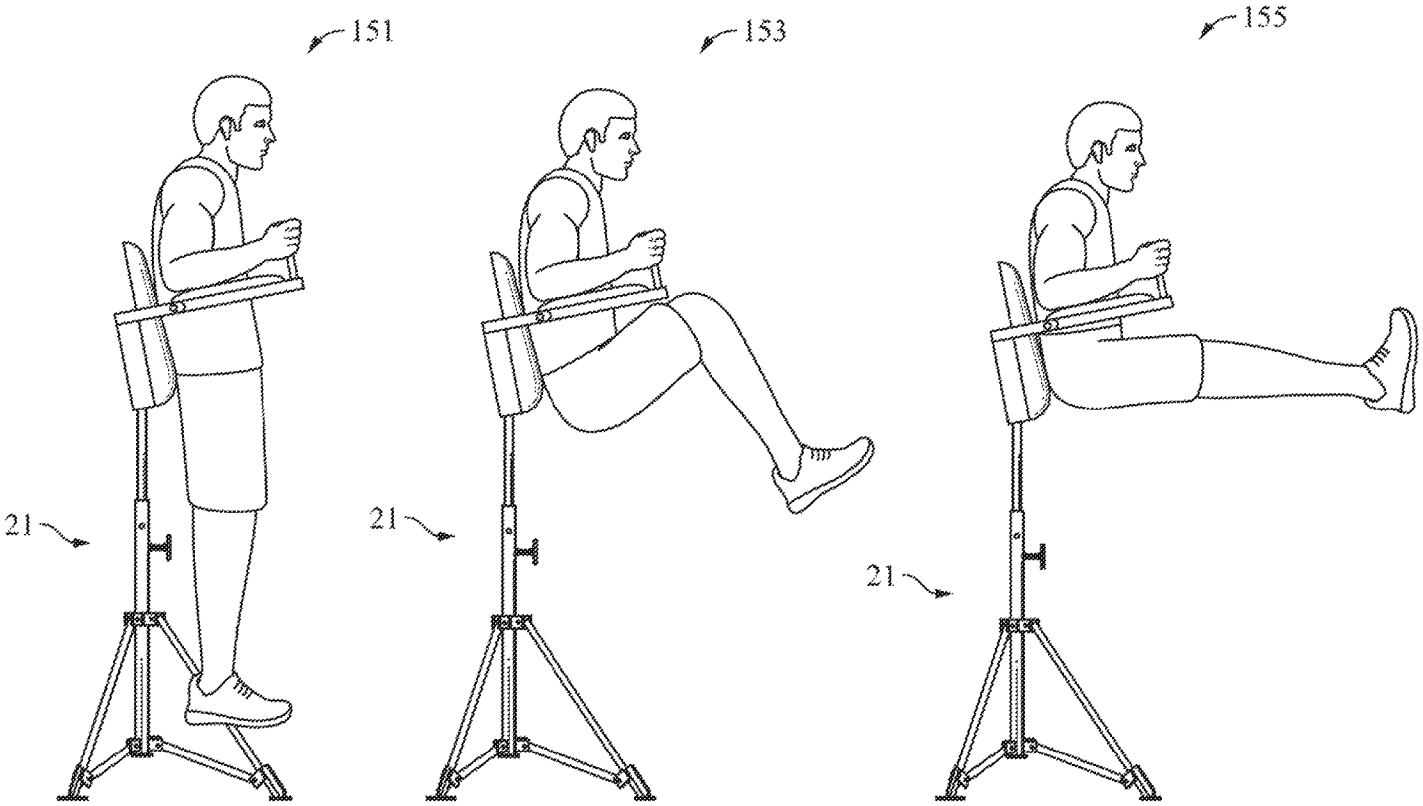
FIG. 9A depicts a person using the VKR with their legs handing down.
FIG. 9B depicts a person using the VKR with their legs folded up to their chest.
FIG. 9C depicts a person using the VKR with their legs stretched straight out at approximately 90° to their torso.

Among the issues a designer and manufacturer of fitness machines and equipment must deal with are the significant weight loads and resulting stress and strains put on them by a person using them. Not only must they use materials, structural steel or aluminum that can carry the loads, the device itself must be designed to sustain shifting of the loads as a person does his or her exercise. The devices must be robust enough and have a sufficiently wide base to avoid tipping over whether the person using the device is 125 pounds or 250 pounds or more. FIGS. 9A, 9B and 9C depict a person using an embodiment of the vertical knee raise machine of the present invention and moving their legs between three standard positions while using the vertical knee raise machine. In FIG. 9A the person's legs are hanging down, in FIG. 9B the knees of the person have been raised to their chest and in FIG. 9C the legs are out in front of the person parallel to the floor and a right angle to the person's torso.

In the case of non-portable machines it is only a matter of making them heavy enough and big enough to take the stress and strain of the dynamic use they will be put to. On the other had the problem is to make a portable and storable vertical knee raise machine that the average person using it can easily set up and use that fold up and store when not in use. In fact this is an extremely difficult task. Most home equipment, in particular vertical knee raise machines do not meet the criteria of a light portable and storable machine. They tend to be non-foldable structures that weigh more than the average person can comfortably move on their own.

However, with the present invention a couple of features have been incorporated into the preferred embodiment of the vertical knee raise machine to help keep its weight in a range that the average person can easily and quickly be set it up in a deployed position for use, then take it down by folding it up for storage and then moving it to a storage space. The first is the putting the back rest a slight backward angle or tilt, so that the person using the vertical knee raise machine is in a slightly backward reclining position as depicted in FIGS. 9A, 9B and 9C. The second is positioning one of the legs of the supporting tripod in an orientation such that the leg projects in the same direction as the legs of someone using the VKR; in effect the legs of the one using the vertical knee raise machine will straddle that leg of the tripod.

In FIG. 9A a person is depicted using the vertical knee raise machine with their legs hanging down 151. In FIG. 9B a person is depicted with their legs folded up against their chest 153. In FIG. 9C a person is depicted with their legs extended straight out 155 at right angle to their torso.

For example, during the use of a universal knee raise machine, as the person does the exercise, a series of repetitions of raising and lowering their legs, as they raise their legs with their back on the backrest and arms on the armrests they shift the center of mass out towards the end of the arm rests. As depicted in Figure SA, a schematic of a vertical knee raise machine where the back rest is not tilted at an angle and forms a plane parallel to the support shaft, it has been determined that when a person is hanging on the vertical knee raise machine similar to that depicted 151 in FIG. 9A with their legs hanging down but the back rest is not titled as depicted in Figure SA the center of mass is shifted 101 out four inches from the axis of the support shaft. When their legs are extended straight out 155 as depicted in FIG. 9C, with the back rest 23 as positioned in FIG. 5A their center of gravity is shifted 103 out 11" from the axis of the support shaft 29.

One the other hand, when as depicted in FIG. 5 the plane of the backrest and shaft axis are as an oblique angle 49 such as 10° the center of mass only moves out 0.38 inches 107 from the axis of the support shaft when the person has his or her legs hanging straight down 151 as depicted in FIG. 9A. When the person's legs are extended straight out 155 as depicted in FIG. 9C and the back rest is angled back at 10° the center of mass only moves out 6" or 7" 109.

This has significance for two reasons. First, its affects the size of the base needed. The second is the amount of flexing in the arm rest may experience, such as the closer the center of mass is to support shaft 29, the less flexing of the arm rests and support shaft will experience. Regarding the tipping factor, the adding of an oblique angle of 10° increases the static tipping safety factor from 1.9 to 47 and the dynamic factor from 1.5 to 2.8. The tipping numbers are dependent on the weight of the user and weight of the tripod and supporting structure. With the figures provided it is steel supporting structure and heavy user. A heavy user with a lighter aluminum structure would have a lower safety factor and lighter user with a steel structure would have a higher safety factor.

Figure 8:
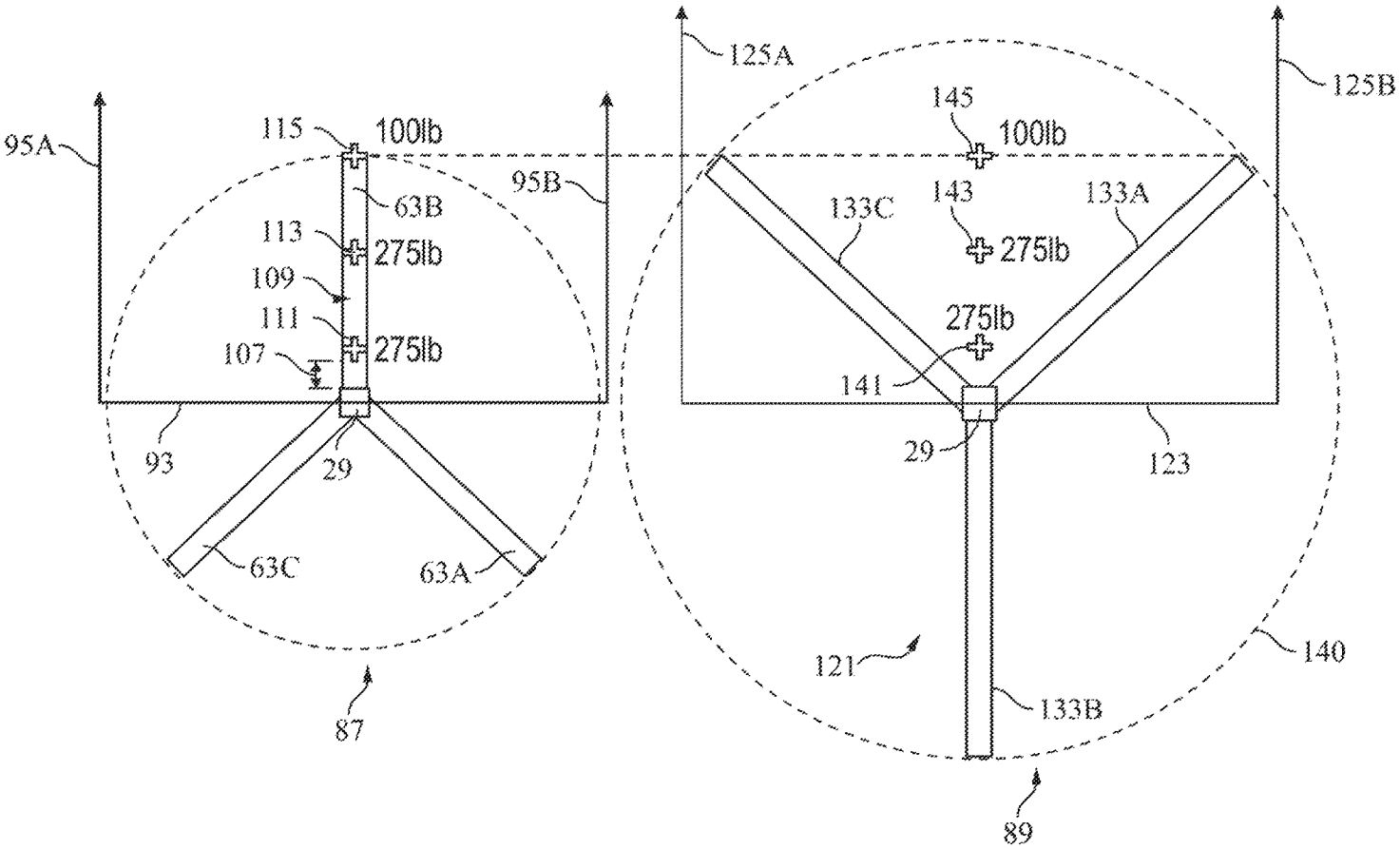
FIG. 8 is a schematic top view of two, different sized tripod bases.

FIG. 8 provides a schematic diagram of two different configurations for positioning the legs of the tripod with respect to the position of the back rest. Configuration 87 has leg 63B pointing in same direction as the person using the vertical knee raise machine. Line 91 indicates the orientation of the back rest and arrows 95A and 95B indicate the direction of the arm rest. Thus, leg 63B points in the direction that a person would be moving their legs. For this example we will assume the back rest is not tilted at 10° but forms a plane parallel to the support shaft. In this case the center of gravity of someone 275 lbs on the VKR with their legs hanging down shift s out 4" to point 111 4" out from support shaft 29. When their legs are raised to a position where they are pointing straight out the center mass shifts out to point 113 11" out from support shaft 29. The indication of 100 lbs at the end indicates that a child of 100 lbs can hang onto the end of the arm rests and the vertical knee raise machine will not tip over. Thus, with the tripod configuration 87 the tripod base only needs a radius of 18".

However, when the tripod base is configured 89 as base 121 is with the plane of the back rest indicated by 123 and the direction of the arm rests indicated by arrows 125A and 125B, leg 133B points away from the direction a person will be lifting their legs. This then requires a larger tripod base as indicated by circle 141. All of the legs 133A, 133B and 133C must be extended to accommodate the same load as indicated by the center of mass shifts for a person with the legs hanging 141 and their legs lifted and pointing out 143 and for a child of 100 lbs hanging off of the end.

Additionally, it will be readily apparent now that when the back rest is tilted back as depicted in FIG. 5 and FIGS. 9A to 9C the center of mass remains even closer to the back rest and makes the vertical knee raise machine even more stable and able to handle heavier loads. In fact when the back rest is tilted at 10° the center of mass is only 0.38 of an inch 107 from support shaft 29 as indicated in FIG. 8, see also FIG. 5. When the person stretches their legs straight out as indicated in FIG. 9C the center of mass of the person only moves out about 6" from support shaft 29. Thus, tilting of the back rest by about 10° as indicated in FIG. 5 adds significant stability to the vertical knee raise machine during use.

In one embodiment of the vertical knee raise machine shaft 29 is a solid preset length connecting supper structure 75 to the tripod base. However, the length of shaft 29 can be varied if desired. In the variation depicted in FIG. 2 shaft 29 fits into tube 32 which forms part of the tripod base. Tube 32 has apertures 34 in it that snap pin 36 can be inserted through which passes through a similar hole in shaft 29. The apertures are not visible in shaft 29 because they are covered by tube 32, and are located along shaft 29 to allow it to be adjusted for height by moving shaft 29 up or down and inserting pin 36 when holes on shaft 29 are aligned with apertures on tube 32.

The vertical knee raise machine of the present invention can be made of any high strength but lightweight material that and handle the loads put on the vertical knee raise machine. One such material is A36 steel. Another alternative that can be used is A106 steel. Additionally, any similar light, high strength material similar in function and characteristics to A26 steel and A106 steel can be used. Many grades of aluminum would also be an acceptable material choice such as 6000 series aluminum alloys. Additionally, carbon fiber composites, titanium and other materials could be used that can bear the sustained loading the VKR would experience during use.

It will be apparent to those skilled in the art that various modifications and variations can be made without departing from the spirit or scope of the invention. Since modifications combinations, sub-combinations and variations of the disclosed embodiments incorporating the spirit and substance of the invention may occur to persons skilled in the art, the invention should be construed to include everything within the scope of the appended claims and their equivalents.

What is claimed is:

1. A vertical knee raise machine comprising:

a. a tripod base movable between a deployed support position and a folded storage position;

b. a backrest with a left armrest connected at a first end to said backrest and a right armrest connected at a first end to said backrest;

c. a support: shaft with a first end connected to said tripod base and a second end connected to said backrest;

d. wherein a plane formed by said backrest is reclined at a preset oblique angle relative to said support shaft; and e. wherein said armrests are retractable from a deployed position to a folded position to thereby put said vertical knee raise machine in a compact storage configuration for storage when said armrests are in said retracted position and said tripod base is in said folded storage position.

2. The vertical knee raise machine of claim 1 wherein said preset oblique angle between said backrest and said shall is 10°.

3. The vertical knee raise machine of claim 1 wherein said preset oblique angle between said backrest and said shall can vary from 5° to 15°.

4. The vertical knee raise machine of claim 1 wherein a length of said shaft connecting said tripod base to said backrest can be adjusted to vary the distance between said tripod base and said backrest, to thereby allow persons of different heights to use said vertical knee raise machine.

5. The vertical knee raise machine of claim 1 wherein when said armrests are in said deployed position, a right angle is formed between a plane of said armrests and said plane of said backrest.

6. The vertical knee raise machine of claim 1 wherein when said right and left armrests in said retracted position, said armrests form a plane congruent with said support shaft.

7. The vertical knee raise machine of claim 1 wherein when said tripod base is deployed in said support position, one leg of said tripod base forms a plane perpendicular to a plane formed by said back rest and projects in the same direction as said armrests.

8. The vertical knee raise machine of claim 1 wherein said machine is made of a material selected from the group consisting of A36 steel and A106 steel.

9. The vertical, knee raise machine of claim 1 wherein said left armrest has a hand grip at a second end of said left armrest, and said right armrest has a hand grip at a second end of said right armrest.

10. The vertical knee raise machine of claim 1 wherein said support shaft is oriented in a vertical direction.

11. The vertical knee raise machine of claim 1 wherein said second end of said support shaft which connects to said back rest is bent at said preset oblique angle to thereby position said backrest at said present oblique angle.

12. A vertical knee raise machine comprising:

a. a tripod base movable between a deployed support position and a folded storage position;

b. a backrest with a left armrest connected at a first end to said backrest with a hand grip at a second end of said left armrest and a right armrest connected at a first end to said backrest with a hand grip at a second end of said right armrest;

c. a support shaft with a first end connected to said tripod base and a second end connected to said backrest;

d. wherein a plane formed by said backrest is reclined at a preset oblique relative angle to said support shaft;

e. wherein said armrests are retractable from a deployed position to a folded position to thereby put said vertical knee raise machine in a compact storage configuration for storage when said armrests are in said retracted position and said tripod base is in said folded storage position;

f. wherein said preset oblique angle between said backrest and said shaft is 10';

g. wherein when said armrests are in said deployed position, a right angle is formed between a plane of said armrests and said plane of said backrest; and h. wherein when in the deployed position, a leg of said tripod base projects in the same direction as the legs of a person using said vertical knee raise machine.

13. A vertical knee raise exercise method comprising:

a. providing an apparatus having a foldable tripod base permitting storage in a substantially flat configuration and permitting a working configuration adjustable at a desired height for elbow or forearm supports;

b. adjusting the apparatus for use by a user, performing vertical knee raise exercises using the apparatus; and c. adjusting the apparatus for storage in the substantially flat configuration.

* * * * *